US009752284B2

(12) United States Patent
Hietaniemi et al.

(10) Patent No.: US 9,752,284 B2
(45) Date of Patent: Sep. 5, 2017

(54) METHOD FOR TREATING A FIBRE STOCK FOR MAKING OF PAPER, BOARD OR THE LIKE AND PRODUCT

(71) Applicant: Kemira Oyj, Helsinki (FI)

(72) Inventors: Matti Hietaniemi, Espoo (FI); Mikko Virtanen, Helsinki (FI); Emmi Saranpää, Espoo (FI)

(73) Assignee: KEMIRA OYJ, Helsinki (FI)

( * ) Notice: Subject to any disclaimer, the term of this patent is extended or adjusted under 35 U.S.C. 154(b) by 45 days.

(21) Appl. No.: 14/442,182

(22) PCT Filed: Nov. 12, 2013

(86) PCT No.: PCT/FI2013/051067
§ 371 (c)(1),
(2) Date: May 12, 2015

(87) PCT Pub. No.: WO2014/072587
PCT Pub. Date: May 15, 2014

(65) Prior Publication Data

US 2016/0289896 A1 Oct. 6, 2016

(30) Foreign Application Priority Data

Nov. 12, 2012 (FI) ..... 20126180

(51) Int. Cl.

| | |
|---|---|
| ***D21H 21/18*** | (2006.01) |
| ***D21H 17/37*** | (2006.01) |
| ***D21H 17/29*** | (2006.01) |
| ***D21H 23/04*** | (2006.01) |
| *D21H 27/30* | (2006.01) |

(52) U.S. Cl.
CPC ..... *D21H 21/18* (2013.01); *D21H 17/29* (2013.01); *D21H 17/375* (2013.01); *D21H 23/04* (2013.01); *D21H 27/30* (2013.01)

(58) Field of Classification Search
CPC ..... D21H 17/375; D21H 21/18; D21H 21/10; D21H 21/20; D21H 17/29; D21H 17/37; D21H 23/14; D21H 17/45; D21H 17/42; D21H 23/04; D21H 17/07; D21H 17/41; D21H 17/44; D21H 23/765; D21H 23/18
See application file for complete search history.

(56) References Cited

U.S. PATENT DOCUMENTS

| | | | | | |
|---|---|---|---|---|---|
| 4,066,495 | A * | 1/1978 | Voigt | C08L 3/08 | 162/162 |
| 4,908,100 | A * | 3/1990 | Hunter | D21H 21/10 | 162/168.3 |
| 5,185,062 | A | 2/1993 | Begala | | |
| 6,033,525 | A * | 3/2000 | Moffett | C08B 31/00 | 106/238 |
| 6,048,438 | A * | 4/2000 | Rosencrance | D21H 23/14 | 162/158 |
| 6,168,686 | B1 * | 1/2001 | Sutman | D21H 23/765 | 162/142 |
| 6,294,645 | B1 * | 9/2001 | Allen | C08G 73/028 | 523/414 |
| 7,955,473 | B2 * | 6/2011 | Solhage | D21H 17/375 | 162/158 |
| 8,088,251 | B2 * | 1/2012 | Buwono | D21H 23/14 | 162/164.2 |
| 8,425,725 | B2 * | 4/2013 | Buwono | D21H 23/14 | 162/164.2 |
| 8,425,726 | B2 * | 4/2013 | Buwono | D21H 23/14 | 162/164.2 |
| 8,790,493 | B2 * | 7/2014 | Solhage | D21H 17/375 | 162/158 |
| 8,980,056 | B2 * | 3/2015 | Lu | D21H 21/18 | 162/164.1 |
| 9,279,217 | B2 * | 3/2016 | Hietaniemi | D21H 27/002 | |
| 9,347,181 | B2 * | 5/2016 | Lu | D21H 17/43 | |
| 2006/0130991 | A1 * | 6/2006 | Solhage | D21H 17/375 | 162/158 |
| 2009/0165978 | A1 * | 7/2009 | Hagiopol | C08F 220/56 | 162/168.3 |
| 2010/0288457 | A1 * | 11/2010 | Buwono | D21H 23/14 | 162/164.2 |
| 2011/0048660 | A1 | 3/2011 | Esser et al. | | |
| 2012/0067534 | A1 * | 3/2012 | Buwono | D21H 23/14 | 162/164.6 |
| 2012/0067535 | A1 * | 3/2012 | Buwono | D21H 23/14 | 162/164.6 |

(Continued)

FOREIGN PATENT DOCUMENTS

| | | | | | |
|---|---|---|---|---|---|
| EP | 0362770 | A2 | | 4/1990 | |
| FI | WO 2014072587 | A1 | * | 5/2014 | D21H 17/375 |
| JP | 56159397 | A | * | 12/1981 | |
| JP | 60185900 | A | * | 9/1985 | |
| SE | WO 2006068576 | A1 | * | 6/2006 | D21H 23/18 |
| WO | WO 0011267 | A1 | * | 3/2000 | D21H 17/29 |
| WO | 03087473 | A1 | | 10/2003 | |
| WO | 2012042115 | A1 | | 4/2012 | |
| WO | 2012067877 | A1 | | 5/2012 | |
| WO | WO 2015110703 | A1 | * | 7/2015 | D21H 17/36 |

OTHER PUBLICATIONS

International Search Report for PCT/FI2013/051067 mailed May 15, 2014.
National Board of Patents and Registration of Finland Search Report for 20126180 mailed Aug. 28, 2013.

*Primary Examiner* — Jose Fortuna
(74) *Attorney, Agent, or Firm* — Thomas Horstemeyer, LLP

(57) ABSTRACT

The invention relates to a method for treating a fiber stock for making of paper, board or the like. The method comprises obtaining a fiber thick stock and adding to the fiber thick stock at least one cationic first agent, and adding separately to the fiber stock and after the addition of the cationic first agent, at least one anionic second agent, which is an water-soluble anionic copolymer of acrylamide, methacrylamide or acrylonitrile, in such amount that the ratio of the added absolute cationic charge to the added absolute anionic charge is from 1:0.1 to 1:0.95. The invention relates also to the product prepared by using a fiber stock, which is treated by using the method.

22 Claims, No Drawings

(56) References Cited

U.S. PATENT DOCUMENTS

| | | | | |
|---|---|---|---|---|
| 2012/0118523 | A1* | 5/2012 | Lu | D21H 21/18 162/164.6 |
| 2014/0110073 | A1* | 4/2014 | Karppi | D21H 17/72 162/164.3 |
| 2015/0144282 | A1* | 5/2015 | Lu | D21H 17/43 162/164.5 |
| 2016/0273166 | A1* | 9/2016 | Karppi | D21H 17/375 |
| 2016/0289896 | A1* | 10/2016 | Hietaniemi | D21H 17/375 |
| 2017/0002518 | A1* | 1/2017 | Hokka | D21H 17/36 |

* cited by examiner

METHOD FOR TREATING A FIBRE STOCK FOR MAKING OF PAPER, BOARD OR THE LIKE AND PRODUCT

CROSS-REFERENCE TO RELATED APPLICATION

This application is the 35 U.S.C. §371 national stage application of PCT Application No. PCT/FI2013/051067, filed Nov. 12, 2013, the entirety of which is hereby incorporated by reference.

The present invention relates to a method for treating a fibre stock for making of paper, board or the like as well as to a product according to methods as described herein.

When fibre stock is prepared for making paper, board or the like, the properties of the stock and the fibres are modified in order to improve the behaviour of the stock during the web forming process and/or to improve the properties of final paper or board. One desirable property of the final paper or board is its dry strength. The properties of the fibre stock may be modified by treating the fibres mechanically, e.g. by mechanical refining, or by treating the fibre stock by adding different chemicals to the stock. Typically dry strength is improved by addition of dry strength agents, such as cationic starch, to the fibre stock, or by addition of polyelectrolyte complexes containing a cationic polymer and an anionic polymer, during the papermaking process. These practises have, however, their drawbacks. Especially, they are not optimal for making of paper with high filler content.

In papermaking there is a permanent interest to increase the filler content in the base paper, because inorganic fillers are relatively cheap raw material. Increase of the filler content decreases, however, the strength properties of the formed base paper and increases the amount of strength agents needed in the process. In paperboard making there is an interest for producing board with light basis weight while maintaining the bending stiffness of the final board.

An object of the present invention is to minimise or even eliminate the problems existing in the prior art.

Another object of the present invention is to provide a method, with which it is possible to maintain the strength properties of the paper or board, even at high filler content or at low basis weight.

These objects are attained with the invention having the characteristics presented below in the characterising parts of the independent claims.

Typical method according to the present invention for treating or preparing a fibre stock for making of paper, board or the like, comprises

- obtaining a fibre thick stock,
- adding to the fibre thick stock at least one cationic first agent,
- adding to the fibre stock, separately and after the addition of the cationic first agent, at least one anionic second agent, which is an water-soluble anionic copolymer of acrylamide, methacrylamide or acrylonitrile, in such amount that the ratio of the added absolute cationic charge to the added absolute anionic charge is from 1:0.1 to 1:0.95.

Typical product according to the present invention is manufactured by using a fibre thick stock prepared or treated by using the method according to the invention.

Now it has been surprisingly found out that a separate and sequential addition of at least one cationic first agent and at least one anionic second agent in amounts that optimise the charge ratio between the cationic and anionic charges enables an effective optimisation of the zeta potential of the fibre stock. When the cationic first agent is added to the fibre stock it interacts with the anionic sites of the fibre surfaces. Then the anionic second agent is added, whereby it interacts with the cationic first agent attached to the fibre surface and forms "bridges" between the fibres. In this manner the binding or attachment of fibres with each other is improved, which improves the strength properties of the paper or board produced. The present invention thus enables the optimisation of the charge ratio between the cationic first agent and the anionic second agent, and provides more freedom in selecting the cationic agent which is used. The present invention provides the fibres with cationic and anionic layers or sites, which improve the interaction between the fibres. The successive addition of the first and second agent enables also more freedom in selecting the individual agents used. For example, it is possible to use highly cationic first agent in systems with high filler content.

According to one embodiment of the invention the at least one cationic first agent and the at least one anionic second agent may be added to the fibre stock in such amount that the ratio of the added absolute cationic charge to the added absolute anionic charge is from 1:0.1 to 1:0.5, preferably from 1:0.2 to 1:0.4. This charge ratio provides advantageous optimisation between the costs of the used agents and the obtained strength of the final paper or board.

According to another embodiment of the invention the at least one cationic first agent and the at least one anionic second agent may be added to the fibre stock in amount such that the ratio of the added absolute cationic charge to the added absolute anionic charge is from 1:0.55 to 1:0.95, preferably from 1:0.55 to 1:0.8, more preferably from 1:0.6 to 1:0.8, still more preferably from 1:0.6 to 1:0.7. In some cases, a high strength of the final paper or board is desired. This may be obtained by using the defined charge ratio, providing good strength results.

In this context the terms "absolute cationic charge" and "absolute anionic charge" are understood as the cationic charge value or the anionic charge value without the prefix indicating the charge quality.

The fibre stock exhibits an original zeta potential value before the addition of the cationic first agent and the anionic second agent. According to one embodiment of the invention the addition of cationic first agent increases the original zeta potential value of the fibre stock to a first zeta potential value, which is in the range of −15-+10 mV, preferably in the range of −10-0 mV, and the addition of the anionic second agent decreases the obtained first zeta potential value by 1.5-10 mV, preferably by 2-5 mV. Thus, after the addition of anionic second agent a second zeta potential value is obtained, the second zeta potential value being preferably in the range of −12-−0.5 mV, more preferably −10-−2 mV. In other words the original zeta potential value is preferably increased to a first zeta potential value, which is near neutral or even positive. Conventionally the area near neutral zeta potential is avoided because it easily results in excessive foaming at the outlet of the headbox and retention problems in the formed web. However, the present invention enables the raise of the zeta potential to an area near neutral, because the anionic second agent lowers the zeta potential away from the problematic area before the stock enters the headbox outlet and before the web is formed.

Preferably the cationic first agent is mixed with the fibre stock before the addition of the anionic second agent. In other words, the cationic first agent is allowed to interact with the fibres before the anionic second agent is added. For example, the cationic first agent may be added before a shear stage, in which effective mixing of the cationic first agent and the fibre thick stock is conducted. Thus the interaction between the cationic first agent and the fibres may be guaranteed by adding the cationic first agent, for example, to a machine container or the like and conducting an effective mixing. The cationic first agent may also be added to a connecting pipeline, in which it is mixed to the stock by using mixing pumps, mixing injector or the like. In long pipelines, which are typical for the paper or board mills, the effective mixing may be achieved by turbulence in the pipeline. In that case no specific mixing action is required as long as the addition interval between the first and the second agent is long enough.

According to one preferred embodiment the cationic first agent is added to the fibre thick stock having consistency of at least 2%, preferably at least 3%, even more preferably of about 3.5%. According to one embodiment the cationic first agent is added to the fibre thick stock having consistency of preferably 2-5%, more preferably 3-4%, i.e. to a thick stock. After addition of the cationic first agent the anionic second agent is added to the fibre thick stock at the latest at a head box of paper machine or a board machine. In one embodiment the cationic first agent is preferably added to the thick stock, which is understood as a fibre stock, which has consistency of at least 20 g/l, preferably more than 25 g/l, more preferably more than 30 g/l. Preferably the addition of the cationic first agent is located after the stock storage towers, but before thick stock is diluted in the wire pit or tank (off-machine silo) with short loop white water. According to one embodiment of the invention the cationic first agent and the anionic second agent are added consecutively after each other to the fibre thick stock and the fibre thick stock is diluted with short loop white water of paper or board machine before the web formation. In this context the term "short loop" is synonymous with the term "short circulation". Short loop denotes the flow loop from the wire pit to the machine head box and back to the wire pit. The short loop naturally includes all pumps, cleaning systems, etc. located in the flow loop between the wire pit and the head box.

Typically the cationic first agent is added to the fibre stock in such amount that a filtrate of the fibre stock may have a cationic demand <300 μekv/l, preferably <150 μekv/l after addition of the cationic first agent. Typically the anionic second agent is added in such amount that the cationic demand of the stock filtrate is increased less than 100 μekv/l, preferably less than 50 μekv/l, after the addition of the anionic second agent.

The cationic first agent may be selected from a group comprising cationic copolymers of acrylamide and methacrylamide, cationic starch and any of their mixture. According to one embodiment of the invention it is possible to add to the fibre stock one cationic first agent or a plurality of cationic first agents. In case two or more, i.e. a plurality of cationic first agents is used, they may be added to the stock as a single mixture or solution, or simultaneously but separately, or successively one after another. The cationic first agent may also be a mixture of cationic starch and a cationic copolymer of acrylamide.

According to one embodiment of the invention the cationic first agent is cationic starch, which has a charge density of 0.1-2 meq/g, preferably 0.2-0.9 meq/g, more preferably 0.35-0.85 meq/g. Cationic starch, which is suitable for use in the present invention, may be any cationic starch to be used in paper making, such as potato, rice, corn, waxy corn, wheat, barley or tapioca starch, preferably corn, wheat, potato or tapioca starch. The amylopectin content may be in the range of 65-90%, preferably 70-85% and the amylose content may be in the range of 10-35%, preferably 15-30%. According to one embodiment cationic first agent is cationic starch, where at least 70 weight-% of the starch units have an average molecular weight (MW) over 700 000 Dalton, preferably over 20 000 000 Dalton.

Starch may be cationized by any suitable method. Preferably starch is cationized by using 2,3-epoxypropyltrimethylammonium chloride or 3-chloro-2-hydroxypropyltrimethylammonium chloride, 2,3-epoxypropyltrimethylammonium chloride is being preferred. It is also possible to cationize starch by using cationic acrylamide derivatives, such as (3-acrylamidopropyl)-trimethylammonium chloride. Typically cationic starch may comprise cationic groups, such as quaternized ammonium groups. According to one embodiment the cationic first agent is cationic starch, which has a degree of substitution (DS), indicating the number of cationic groups in the starch on average per glucose unit, in the range of 0.01-0.20, preferably 0.015-0.1, more preferably 0.02-0.08.

According to one embodiment the cationic starch is preferably non-degraded cationic starch, which is modified solely by cationisation, and which backbone is non-degraded and non-cross-linked.

According to another embodiment of the invention the cationic first agent may be a cationic copolymer of acrylamide or methacrylamide. According to one embodiment of the invention the cationic first agent is cationic copolymer of acrylamide or methacrylamide having an average molecular weight (MW) of 300 000-3 000 000 g/mol, preferably 400 000-2 000 000 g/mol, more preferably 500 000-1 500 000 g/mol, even more preferably 500 000-1 000 000 g/mol. Cationic copolymer of acrylamide or methacrylamide may be produced by copolymerising acrylamide or methacrylamide with cationic monomer(s). The cationic first agent may be a cationic copolymer of acrylamide or methacrylamide and at least one cationic monomer, which is selected from the group consisting of methacryloyloxyethyltrimethyl ammonium chloride, acryloyloxyethyltrimethyl ammonium chloride, 3-(methacrylamido) propyltrimethyl ammonium chloride, 3-(acryloylamido) propyltrimethyl ammonium chloride, diallyldimethyl ammonium chloride, dimethylaminoethyl acrylate, dimethylaminoethyl methacrylate, dimethylaminopropylacrylamide, dimethylaminopropylmethacrylamide, and similar monomers. According to one preferred embodiment of the invention cationic first agent is a copolymer of acrylamide or methacrylamide with (meth) acryloyloxyethyltrimethyl ammonium chloride. Cationic polyacrylamide may also contain other monomers, as long as its net charge is cationic and it has an acrylamide/methacrylamide backbone. An acrylamide or methacrylamide based polymer may also be treated after the polymerisation to render it cationic, for example, by using Hofmann or Mannich reactions.

Cationic copolymer of acrylamide or methacrylamide may be prepared by conventional radical-initiation polymerisation methods. The polymerisation may be performed by using solution polymerisation in water, gel-like solution polymerisation in water, aqueous dispersion polymerisation, dispersion polymerisation in an organic medium or emulsion polymerisation in an organic medium. The cationic copolymer of acrylamide or methacrylamide may be obtained either as an emulsion in an organic medium, aqueous dispersion, or as solution in water, or as a dry powder or dry granules after optional filtration and drying steps following the polymerisation. The charge density of the cationic copolymer of acrylamide or methacrylamide may be 0.2-5 meq/g, preferably 0.3-4 meq/g, more preferably 0.5-3 meq/g, even more preferably 0.7-1.5 meq/g.

The anionic second agent is a water-soluble polymer. The term "water-soluble" is understood in the context of this application that the anionic second agent is in form of solution, which is fully miscible with water. The polymer solution of anionic second agent is essentially free from discrete polymer particles. The anionic second agent may be a copolymer of acrylamide, methacrylamide or acrylonitrile and an ethylenically unsaturated monomer. The ethylenically unsaturated monomer may be selected from a group comprising acrylic acid, (meth)acrylic acid, maleic acid, crotonic acid, itaconic acid, vinylsulphonic acid, and 2-acrylamide-2-methylpropanesulfonic acid. Also non charged monomers may be included, as long as the net charge of the polymer is anionic and the polymer has an acrylamide/methacrylamide backbone. Preferably the second agent is anionic copolymer of acrylamide, methacrylamide or acrylonitrile comprising anionic groups attached to the polymer backbone.

The anionic second agent may be crosslinked or non-crosslinked, linear or branched. According to one embodiment of the invention the anionic second agent is preferably linear. The anionic second agent may have an average molecular weight of 200 000-2 000 000 g/mol, preferably 200 000-1 000 000 g/mol, and/or an anionic charge of 0.4-5 meq/g, preferably 0.5-4 meq/g, more preferably 0.6-3 meq/g, 0.8-2.5 meq/g, even more preferably 0.8-1.5 meq/g.

According to one embodiment of the invention it is possible to add to the fibre stock two or more different anionic second agents. In case a plurality of different anionic second agents is used, they may be added to the stock as a mixture, or simultaneously but separately, or successively one after another. Two or more anionic second agents may differ from each other on basis of their physical and/or chemical properties, such as viscosity, chemical structure, etc.

For example, in one embodiment of the invention the fibre stock, which has been treated with the cationic first agent and the anionic second agent, as described above, is used for making a product, which is paper, board or the like having a base paper ash content of >10%, preferably >20%, more preferably >25%. Optionally the paper, board or the like comprises also starch at least 5 kg/(base paper ton), preferably at least 10 kg/(base paper ton) and anionic polyacrylamide at least 0.3 kg/(base paper ton), preferably at least 0.6 kg/(base paper ton). Standard ISO 1762, temperature 525° C., is used for ash content measurements.

In one embodiment of the invention the fibre stock, which has been treated with the cationic first agent and the anionic second agent, as described above, is used for making a paper product having a base paper ash content of 5-45%, preferably 13-30%, more preferably 13-25%, even more preferably 15-25%.

According to another embodiment of the invention the fibre stock, which has been treated with the cationic first agent and the anionic second agent, as described above, is used for making a product which is multilayered paperboard comprising starch in amount of 0.3-4 kg/(thick stock ton) and anionic polyacrylamide at least >0.1 kg/(thick stock ton), preferably >0.4 kg/(thick stock ton).

EXPERIMENTAL

Some embodiments of the invention are further described in the following non-limiting examples.

General principle of manufacturing hand sheets with Rapid Köthen hand sheet former, ISO 5269/2, is as follows:

Fibre suspensions are diluted to 1% consistency either with clear filtrate of paper machine process water, if available, or with tap water, which conductivity has been adjusted with NaCl to correspond the conductivity of real process water. The pulp suspension is stirred at a constant stirring rate. Stirring of board stock is performed at 1000 rpm and paper stock at 1500 rpm in a jar with a propeller mixer. Treatment agents for improving the dry strength are added into the suspension under stirring. From the addition of the first treatment agent the total stirring time is 5 min in order to ensure a proper reaction. When treatment agent systems according to the present invention are used, the cationic first agent is added first and anionic second agent is added 2 min after the addition of the first agent. After 5 min of total stirring time, the pulp suspension is diluted to a consistency of 0.5% with white water, i.e filtrate from paper machine's wire section. The optional retention chemical, if any, is added and stirred to pulp slurry 10 s before sheet forming. Optional fillers are added to stock 20 s before sheet forming, if needed. All sheets are dried in vacuum dryers 5 min at 1000 mbar pressure and at 92° C. temperature. After drying sheets are pre-conditioned for 24 h at 23° C. in 50% relative humidity before testing the tensile strength of the sheets.

General principle of Zeta potential measurements for pulp samples is as follows: Pulp samples for zeta potential measurements are diluted to approximately 1% consistency either with a clear filtrate of paper machine process water, if available, or with tap water, which conductivity has been adjusted with NaCl to correspond the conductivity of real process water. Zeta potential is determined using Mütek SZP-06 System Zeta Potential device (BTG Instruments GmbH, Herrsching, Germany). This device applies a vacuum to draw pulp stock against a screen and forms a pad of fines and fibres between two electrodes. A pulsating vacuum causes the aqueous phase to oscillate through the plug, thus shearing off the counter ions and generating a streaming potential. The zeta potential is calculated by using the measured streaming potential, conductivity, and the pressure difference. The chemical treatment time, before each measurement, is obtained in 5 min.

Other Measurements for Pulp Samples:

Other measurement methods and devices used for characterisation of pulp are disclosed in Table 1.

TABLE 1

Methods and devices used for characterisation of pulp.

| Measurement | Device |
|---|---|
| pH | Knick Portamess. Van London-pHoenix company, Texas, USA |
| Charge | Mütek PCD 03, BTG Instruments GmbH, Herrsching, Germany |
| COD | DR Lange Lasa 100, Hach Lange GmbH, Düsseldorf, Germany |

Measurements for Hand Sheet Samples:

Measurement methods and devices used for characterisation of hand sheet samples are disclosed in Table 2.

TABLE 2

Measured hand sheet properties and standard methods.

| Measurement | Standard, Device |
|---|---|
| Grammage | ISO 536, Mettler Toledo |
| Ash content | ISO 1762, Precisa PrepAsh 229 |
| Tensile strength | ISO 1924-3, Lorentzen & Wettre Tensile tester |
| Scott bond | T 569, Huygen Internal Bond tester |

Example 1

Hand sheets are formed as described above using following raw materials and chemicals:

Fibres: old corrugated cardboard, OCC, 50% long fibre fraction and 50% short fibre fraction First Agent: Agent A is a composite of cationic starch and cationic polyacrylamide, Agent B is glyoxylated cationic polyacrylamide Second Agent: anionic polyacrylamide Retention agent: cationic polyacrylamide, dosage 150 g/t.

Sheet basis weight: 110 g/m$^2$.

Properties of the used fibre fractions, clear filtrate and white water are given in Table 3. The values are obtained by the methods and devices described above.

TABLE 3

Properties of the fibre fractions, clear filtrate and white water of Example 1.

| | OCC long fibre fraction | OCC short fibre fraction | Clear filtrate | White water |
|---|---|---|---|---|
| pH | 6.85 | 6.88 | 7.33 | 7.43 |
| Charge, μekv/l | −164.82 | −207.99 | −398.03 | −391.61 |
| Zeta potential, mV | −12 | −9.9 | — | — |
| Consistency, g/l | 42.45 | 38.055 | — | — |
| Ash content, % | 7.56 | 7.81 | — | — |

Tensile strength values of the hand sheets are measured at 10% ash content. Results are given in Table 4. C/A value is the ratio of absolute added cationic charges to absolute added anionic charges. An improvement in tensile strength may be observed when a cationic first agent and an anionic second agent are added to the stock.

TABLE 4

Results for hand sheets prepared in Example 1.

| #Test | 1$^{st}$ Agent A kg/t (dry) | 1$^{st}$ Agent B kg/t (dry) | 2$^{nd}$ Agent kg/t (dry) | Tensile increase % | C/A | Zeta potential mV |
|---|---|---|---|---|---|---|
| Ref. 1 | — | — | — | 0.0 | | −14.2 |
| 2 | 3 | — | — | 12.6 | 0 | −12.4 |
| 3 | 3 | — | 1.20 | 18.4 | 2.12 | −12 |
| 4 | 3 | — | 2.40 | 19.2 | 1.06 | −12.2 |
| 5 | — | 2.25 | — | 7.5 | 0 | −14.2 |
| 6 | — | 2.25 | 0.20 | 10.2 | 4.03 | −14.5 |
| 7 | — | 2.25 | 0.40 | 11.6 | 2.01 | −14.5 |

Example 2

Hand sheets are formed as described above using following raw materials and chemicals:

Fibre material: Fine paper kraft pulp, 75% birch fraction and 25% pine fraction

First Agent: Agent S is cationic potato starch having DS 0.035, Agent A is a composite of cationic starch and cationic polyacrylamide, Second Agent: anionic polyacrylamide Retention agent: Cationic polyacrylamide, dosage 150 g/t.

Filler: Precipitated calcium carbonate

Sheet basis weight: 80 g/m$^2$.

Properties of the used fibre fractions, clear filtrate and white water are given in Table 5. The values are obtained by the methods and devices described above.

TABLE 5

Properties of the fibre fractions, clear filtrate and white water of Example 2.

| | Pine fraction | Birch fraction | Clear filtrate | White water |
|---|---|---|---|---|
| pH | 7.9 | 8.15 | 7.3 | 7.75 |
| Charge, μekv/l | −48.37 | −27.46 | −3.82 | −36.54 |
| Zeta potential, mV | −18.9 | −19.4 | — | — |
| Consistency, g/l | 25.9 | 22.38 | — | — |
| Ash content, % | 0.85 | 1.13 | — | — |

Tensile strength values of the hand sheets are measured at 10% ash content. Results are given in Table 6. C/A value is the ratio of absolute added cationic charges to absolute added anionic charges. An improvement in tensile strength may be observed when a cationic first agent and an anionic second agent are added to the stock. The tensile strength is increasing with the increasing dosage of the anionic second agent.

TABLE 6

Results for hand sheets prepared in Example 2.

| #Test | 1$^{st}$ Agent S kg/t (dry) | 1$^{st}$ Agent A kg/t (dry) | 2$^{nd}$ Agent kg/t (dry) | Tensile increase % | C/A | Zeta potential mV |
|---|---|---|---|---|---|---|
| Ref. 1 | — | — | — | 0.0 | | −31.1 |
| 2 | 15 | — | — | 0.9 | 0 | −12 |
| 3 | 15 | — | 0.90 | 17.8 | 3.14 | −18.2 |
| 4 | 15 | — | 1.80 | 14.3 | 1.65 | −20.9 |
| 5 | — | 3 | — | 5.9 | 0 | −20.4 |
| 6 | — | 3 | 0.80 | 9.6 | 3.18 | −28.2 |

TABLE 6-continued

Results for hand sheets prepared in Example 2.

| #Test | 1st Agent S kg/t (dry) | 1st Agent A kg/t (dry) | 2nd Agent kg/t (dry) | Tensile increase % | C/A | Zeta potential mV |
|---|---|---|---|---|---|---|
| 7 | — | 3 | 1.50 | 18.4 | 1.70 | −30.2 |
| 8 | — | 3 | 2.40 | 23.3 | 1.06 | −31 |

Example 3

Hand sheets are formed as described above using following raw materials and chemicals:

Fibre material: Fine paper kraft pulp, 75% birch fraction and 25% pine fraction

First Agent: Agent S is cationic potato starch having DS 0.035, Agent A is a composite of cationic starch and cationic polyacrylamide Second Agent: anionic polyacrylamide Retention agent: Cationic polyacrylamide, dosage 150 g/t.

Filler: Precipitated calcium carbonate

Sheet basis weight: 80 g/m$^2$.

Properties of the thick stock, which is used for making the hand sheets, are given in Table 7. The values are obtained by the methods and devices described above.

TABLE 7

Properties of the thick stock used in Example 3.

| | Thick stock |
|---|---|
| pH | 8.3 |
| Charge, μekv/l | −202 |
| Zeta potential, mV | 24.6 |
| Consistency, g/l | 38.3 |
| Ash content, % | 12.5 |

Tensile strength values of the hand sheets are measured at 30% ash content. Results are given in Table 8. C/A value defined the same way as in Example 2. An improvement in tensile strength may be observed when a cationic first agent and an anionic second agent are added to the stock.

TABLE 8

Results for hand sheets prepared in Example 3.

| #Test | 1st Agent S kg/t (dry) | 1st Agent A kg/t (dry) | 2nd Agent kg/t (dry) | Tensile increase % | C/A |
|---|---|---|---|---|---|
| Ref. 1 | — | — | — | 0.0 | |
| 2 | 6 | — | — | 10.6 | 0 |
| 3 | 6 | — | 0.40 | 35.9 | 2.97 |
| 4 | 12 | — | — | 36.2 | 0 |
| 5 | 12 | — | 0.80 | 47.2 | 2.97 |
| 6 | 12 | — | 1.60 | 57.9 | 1.49 |
| 7 | — | 1.29 | — | −4.1 | 0 |
| 8 | — | 1.29 | 0.40 | 1.5 | 2.74 |
| 9 | — | 1.29 | 0.80 | 6.2 | 1.37 |
| 10 | — | 2.58 | — | 2.9 | 0 |
| 11 | — | 2.58 | 0.80 | 5.9 | 2.74 |
| 10 | — | 2.58 | 1.20 | 7.3 | 1.83 |
| 12 | — | 2.58 | 1.60 | 11.1 | 1.37 |

Example 4

Hand sheets are formed as described above using following raw materials and chemicals:

Fibre material: Softwood kraft pulp, pine

First Agent: Agent S is cationic potato starch having DS 0.035, Agent A is a composite of cationic starch and cationic polyacrylamide Second Agent: anionic polyacrylamide Retention agent: Cationic polyacrylamide, dosage 150 g/t.

Filler: Precipitated calcium carbonate

Sheet basis weight: 80 g/m$^2$.

Properties of the thick stock, which is used for making the hand sheets, are given in Table 9. The values are obtained by the methods and devices described above.

TABLE 9

Properties of the thick stock used in Example 4.

| | Thick stock |
|---|---|
| pH | 6.96 |
| Charge, μekv/l | −15.5 |
| Zeta potential, mV | −15.3 |
| Consistency, g/l | 24.8 |
| Ash content, % | 0.2 |

Tensile strength values of the hand sheets are measured. Results are given in Table 10. C/A value is the ratio of absolute added cationic charges to absolute added anionic charges. An improvement in tensile strength may be observed when a cationic first agent and an anionic second agent are added to the stock.

TABLE 10

Results for hand sheets prepared in Example 4.

| #Test | 1st Agent S kg/t (dry) | 1st Agent A kg/t (dry) | 2nd Agent kg/t (dry) | Tensile increase % | C/A |
|---|---|---|---|---|---|
| Ref. 1 | — | | | 0.0 | |
| 2 | 5 | | | 8.9 | 0 |
| 3 | 5 | | 0.40 | 14.3 | 2.48 |
| 4 | 15 | | | 18.6 | 0 |
| 5 | 15 | | 1.20 | 33.3 | 2.48 |
| 6 | | 1.075 | | 13.5 | 0 |
| 7 | | 1.075 | 0.40 | 19.4 | 2.28 |
| 8 | | 3.225 | | 19.1 | 0 |
| 9 | | 3.225 | 1.20 | 37.7 | 2.28 |

Example 5

Hand sheets are formed as described above using following raw materials and chemicals:

Fibre material: 56% CTMP, 18% pine, 26% broke

First Agent: Agent S is cationic potato starch having DS 0.035,

Second Agent: anionic polyacrylamide

Retention agent: Cationic polyacrylamide, dosage 150 g/t.

Sheet basis weight: 110 g/m$^2$.

Properties of the thick stock and white water, which are used for making the hand sheets, are given in Table 11. The values are obtained by the methods and devices described above.

TABLE 11

Properties of the thick stock and white water used in Example 5.

| | Thick stock | White water |
|---|---|---|
| pH | 9.4 | 8.71 |
| Charge, μekv/l | −106 | −9.9 |
| Zeta potential, mV | −22.5 | — |
| Consistency, g/l | 31 | — |

Tensile strength and internal bond strength values of the hand sheets are measured. Results are given in Table 12. C/A value is the ratio of absolute added cationic charges to absolute added anionic charges. An improvement in tensile strength and in internal bond strength may be observed when a cationic first agent and an anionic second agent are added to the stock.

TABLE 12

Results for hand sheets prepared in Example 5.

| #Test | 1st Agent S kg/t (dry) | 2nd Agent kg/t (dry) | Tensile increase % | Internal bond strength increase % | C/A | Zeta potential mV |
|---|---|---|---|---|---|---|
| Ref. 1 | 0 | — | 0.0 | 0.0 | | −32.6 |
| 2 | 3 | — | 2.4 | 4.5 | 0 | −31.4 |
| 3 | 6 | — | 4.2 | 14.6 | 0 | −29.8 |
| 4 | 9 | — | 8.8 | 16.3 | 0 | −26.1 |
| 5 | 9 | 0.8 | 14.5 | 29.6 | 2.23 | −30.8 |

Even if the invention was described with reference to what at present seems to be the most practical and preferred embodiments, it is appreciated that the invention shall not be limited to the embodiments described above, but the invention is intended to cover also different modifications and equivalent technical solutions within the scope of the enclosed claims.

The invention claimed is:

1. A method for treating a fibre stock for making of paper or board, the method comprising obtaining a fibre thick stock, adding, to the fibre thick stock, at least one cationic first agent, selected from the group consisting of: cationic starch having a charge density of 0.1-2 meq/g; cationic copolymers of acrylamide or methacrylamide, having a charge density of 0.2-5 meq/g; and any of their mixture; and adding separately to the fibre stock and after adding the at least one cationic first agent, at least one anionic second agent, which is a water-soluble anionic copolymer of acrylamide, methacrylamide or acrylonitrile, and which has an anionic charge of 0.4-5 meq/g in such amount that a ratio of an added absolute cationic charge to an added absolute anionic charge is from 1:0.1 to 1:0.95, whereby the cationic first agent is allowed to interact with the fibres in the thick stock before the anionic second agent is added.

2. The method according to claim 1, characterised in that the at least one cationic first agent and the at least one anionic second agent are added to the fibre stock in amount such that the ratio of the added absolute cationic charge to the added absolute anionic charge is from 1:0.1 to 1:0.5.

3. The method according to claim 1, characterised in that the at least one cationic first agent and the at least one anionic second agent are added to the fibre stock in amount such that the ratio of the added absolute cationic charge to the added absolute anionic charge is from 1:0.55 to 1:0.95.

4. The method according to claim 1, characterised in that the cationic first agent is added to the fibre thick stock having consistency of at least 2%.

5. The method according to claim 1, characterised in that the cationic first agent and the anionic second agent are added consecutively after each other to the fibre thick stock and the fibre thick stock is diluted with short loop white water of paper or board machine before a web formation.

6. The method according to claim 1, characterised in that the cationic first agent is added before a shear stage, in which mixing of the cationic first agent and the fibre thick stock is conducted.

7. The method according to claim 1, characterised in that the anionic second agent is added to the fibre thick stock at the latest at a head box of a paper machine or a board machine.

8. The method according to claim 1, characterised in adding two or more cationic first agents to the fibre thick stock as a single mixture or successively one after another.

9. The method according to claim 1, characterised in that the cationic first agent is cationic starch, which has a charge density of 0.2-0.9 meq/g.

10. The method according to claim 9, characterised in that the cationic first agent is cationic starch, where at least 70 weight-% of the starch units have an average molecular weight (MW) over 700,000 Dalton.

11. The method according to claim 9, characterised in that the cationic first agent is cationic starch, which has a degree of substitution (DS) in a range of 0.01-0.20.

12. The method according to claim 1, characterised in that the cationic first agent is cationic starch, which has an amylopectin content in a range of 65%-90%, and the amylose content is in a range of 10%-35%.

13. The method according to claim 1, characterised in that the cationic first agent is a cationic copolymer of acrylamide or methacrylamide, the cationic copolymer having an average molecular weight (MW) of 300,000-3,000,000 g/mol.

14. The method according to claim 1, characterised in that the cationic first agent is a cationic copolymer of acrylamide or methacrylamide and at least one cationic monomer, which is selected from the group consisting of methacryloyloxyethyltrimethyl ammonium chloride, acryloyloxyethyltrimethyl ammonium chloride, 3-(methacrylamido) propyltrimethyl ammonium chloride, 3-(acryloylamido) propyltrimethyl ammonium chloride, diallyldimethyl ammonium chloride, dimethylaminoethyl acrylate, dimethylaminoethyl methacrylate, dimethylaminopropylacrylamide, and dimethylaminopropylmethacrylamide.

15. The method according to claim 14, characterised in that the cationic first agent is a copolymer of acrylamide or methacrylamide with (meth)acryloyloxyethyltrimethyl ammonium chloride.

16. The method according to claim 1, characterised in that the charge density of the cationic copolymer of acrylamide or methacrylamide is 0.3-4 meq/g.

17. The method according to claim 1, characterised in that the anionic second agent is an anionic copolymer of acrylamide, methacrylamide or acrylonitrile comprising anionic groups attached to the polymer backbone.

18. The method according to claim 17, characterised in that the anionic second agent is a copolymer of acrylamide, methacrylamide or acrylonitrile and an ethylenically unsaturated monomer, which is selected from a group consisting of: acrylic acid, (meth)acrylic acid, maleic acid, crotonic acid, itaconic acid, vinylsulphonic acid, and 2-acrylamide-2-methylpropanesulfonic acid.

19. The method according to claim 1, characterised in that the anionic second agent has an average molecular weight of 200,000-2,000,000 g/mol, and/or an anionic charge of 0.5-4 meq/g.

20. The method according to claim 1, characterised in that a filtrate of the fibre stock has a cationic demand <300 μeq/l after addition of the cationic first agent.

21. The method according to claim 1, characterised in that a cationic demand of a fibre stock filtrate is increased less than 100 μeq/l after adding the at least one anionic second agent.

22. A method for treating a fibre stock for making of paper or board, the method comprising obtaining a fibre thick stock, adding, to the fibre thick stock, at least one cationic first agent, selected from the group consisting of: cationic starch having a charge density of 0.1-2 meq/g; cationic copolymers of acrylamide or methacrylamide, having a charge density of 0.2-5 meq/q; and any of their mixture; and adding separately to the fibre stock and after adding the at least one cationic first agent, at least one anionic second agent, which is an water-soluble anionic copolymer of acrylamide, methacrylamide or acrylonitrile, and which has an anionic charge of 0.4-5 meq/q in such amount that a ratio of an added absolute cationic charge to an added absolute anionic charge is from 1:0.1 to 1:0.95, whereby the cationic first agent is allowed to interact with the fibres in the thick stock before the anionic second agent is added, and whereby adding the at least one cationic first agent increases original zeta potential value of the fibre stock to a first zeta potential value, which is in a range of −15-+10 mV, and adding the at least one anionic second agent decreases an obtained first zeta potential value by 1.5-10 mV.

* * * * *